US005282512A

United States Patent [19]

Besson et al.

[11] Patent Number: 5,282,512

[45] Date of Patent: Feb. 1, 1994

[54] DRILLING TOOL WITH ROTATING CONICAL ROLLERS

[75] Inventors: Alain Besson, Sartrouville; Patrick Toutain, Sevres, both of France

[73] Assignee: Total, Puteaux, France

[21] Appl. No.: 896,308

[22] Filed: Jun. 10, 1992

[30] Foreign Application Priority Data

Jun. 11, 1991 [FR] France ..... 91 07048

[51] Int. Cl.[5] ..... E21B 10/52

[52] U.S. Cl. ..... 175/374; 175/420.2

[58] Field of Search ..... 175/374, 415, 420.2, 175/434; 76/108.4

[56] References Cited

U.S. PATENT DOCUMENTS

| | | | |
|---|---|---|---|
| 4,148,368 | 4/1979 | Evans | 175/329 |
| 4,339,009 | 7/1982 | Busby | 175/374 |
| 4,722,405 | 2/1988 | Langford, Jr. | 175/374 |
| 4,940,099 | 7/1990 | Deane et al. | 175/374 |

FOREIGN PATENT DOCUMENTS

| | | |
|---|---|---|
| 29535 | 6/1981 | European Pat. Off. . |
| 2029550 | 1/1970 | France . |
| 2268940 | 4/1975 | France . |
| 1014433 | 12/1965 | United Kingdom . |

*Primary Examiner*—William P. Neuder

*Attorney, Agent, or Firm*—Sughrue, Mion, Zinn, Macpeak and Seas

[57] ABSTRACT

A drilling tool with rotating conical rollers, such as a bicone, a tricone, etc. wherein each roller is fitted with several circular rows of teeth 22 made of tungsten carbide or the like. Each tooth has at its end, successively in the direction where it rolls on the rock, a rear or impact zone 24, a central zone 28 with a rounded shape, and a forward zone 30 which is last to come into contact with the rock. The teeth are fitted with diamond-charged elements 32, 34 on the forward zone and optionally on the central zone, but not on the rear zone.

7 Claims, 3 Drawing Sheets

DRILLING TOOL WITH ROTATING CONICAL ROLLERS

BACKGROUND OF THE INVENTION

This invention relates to a drilling tool with rollers, such as a bicone, a tricone, etc. with cutting characteristics that are highly improved compared to tools of the prior art.

To simplify matters reference will only be made to tricones, i.e. drilling tools with three rollers, but the invention also applies to drilling tools with any number of rollers.

A known tricone 10 is shown in FIGS. 1 and 2, and includes a tubular steel body 12 mounted to the end of a tubing, not shown, which drives it in rotation around its axis x—x. In the lower opening of the body three conical steel rollers 14, 16, 18 are mounted to freely rotate, their tops being oriented towards the axis of the tool. The rollers have bearing rings 20 fitted with rows of teeth 22 that can either be tooled directly in the rings and then covered with a coat of tungsten carbide, or comprised of tungsten carbide cutting points mounted inside holes that are tooled in the walls of the rings.

As shown in FIG. 2, the axes of the rollers do not exactly converge on the axis x—x of the tool, but instead they are spaced respectively by a distance d, hereafter the "inter-axis". This shifting can also be characterized by the angular shift angle $\alpha$ that the axis of the roller creates with the radial plane of the tool that contains the center of the base of the roller. Due to this shift, the rollers exert a scraping or abrading effect on the formation rock, and the greater the angle $\alpha$, the more energetic this effect is.

When the rollers 14, 16, 18 are in contact with the rock, the rotation of the tool in the direction of arrow f in FIG. 2 drives the three rollers in the direction of the circular arrows indicated in the Figure.

There are two kinds of tools with rollers:

1) Tools whose rollers have a high angular shift. These tools are efficient for drilling soft or medium-soft rocks, but less so when hard rocks need to be drilled, because as a result of scraping the rock, the teeth or cutting points of the rollers wear out quickly. The tools according to this first kind destroy the rock with the three following actions:

through impact, each time a new tooth 22 strikes the rock, through puncturing, under the effect of the axial force $F_v$ which is exerted on the tool 10, and through abrading-shearing as a result of the scraping of the cutting points on the rock.

2) Tools whose rollers have a small or no angular shift, in which case the rock is destroyed only by the first two effects mentioned above. The cutting points in this second category can be advantageously diamond-charged, but the efficiency of the tool is greatly reduced by the fact that there is no destruction through scraping.

SUMMARY OF THE INVENTION

A purpose of this invention is to improve the efficiency of tools with rollers, such as bicones, tricones, etc., both ones with a small or no angular shift as well as those with a high angular shift and which therefore produce scraping, the latter being used however with hard rocks, without leading to the wear and tear of the teeth or cutting points.

According to the invention, each tooth or cutting point includes a rear or impact zone by which the cutting point comes into initial contact with the rock, a central or sliding zone, and a forward or shearing zone which comes into contact with the rock last, prior to the roller tilting on the following tooth or cutting point, at least a diamond-charged element being placed in the forward zone and possibly in the intermediate zone, but not in the rear zone.

It is known that the use of diamond-charged elements as very hard bodies significantly increases the longevity of the teeth or cutting points, as long as there is no shock. The invention thus places diamond-charged elements only in the zones of the tooth or cutting point where there is scraping, rubbing, sliding, puncturing, or shearing. The rear zone by which the tooth or cutting point first strikes the rock has no diamond-charged element, because it might be destroyed under the effect of a shock.

DETAILED DESCRIPTION OF THE PREFERRED EMBODIMENTS

Figure 1:
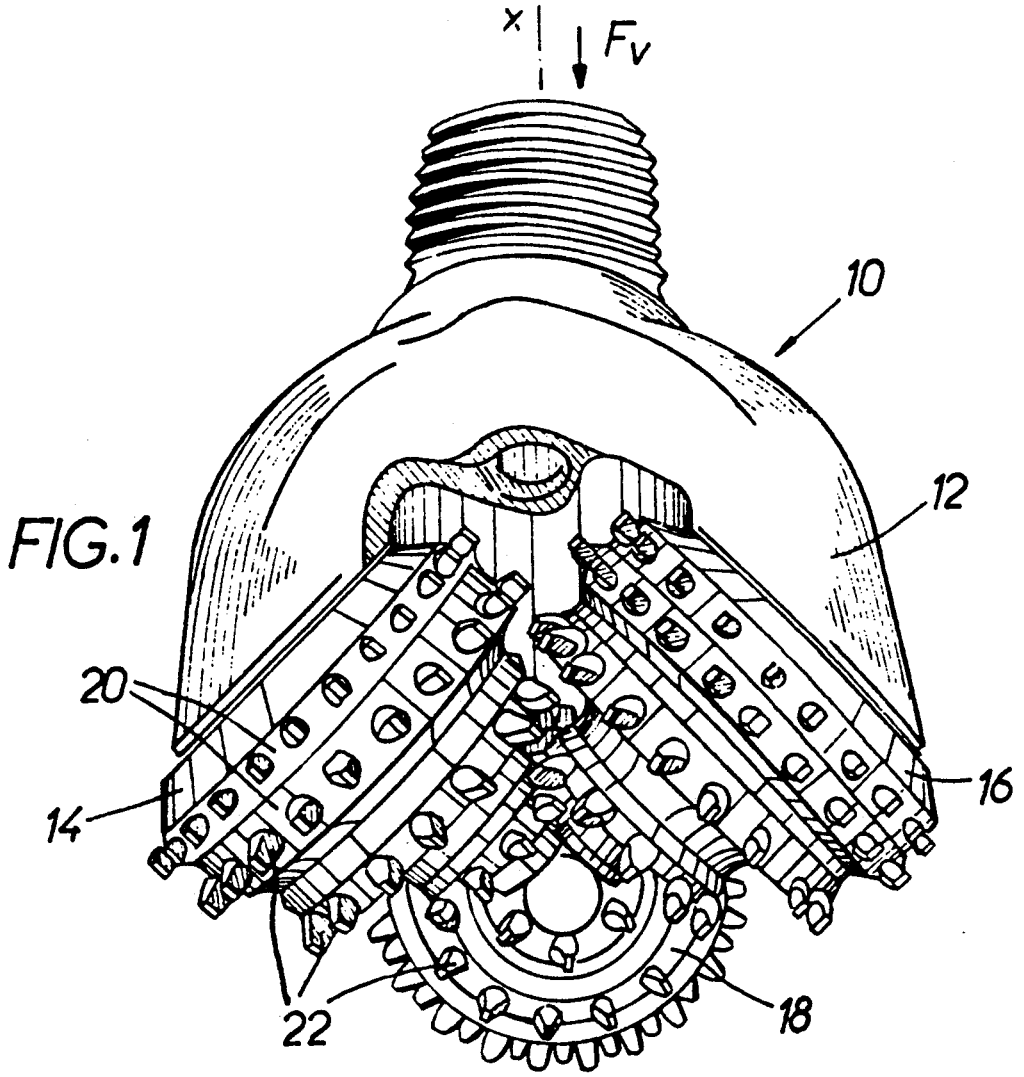
FIG. 1 is a perspective view of a known tricone.
Figure 2:
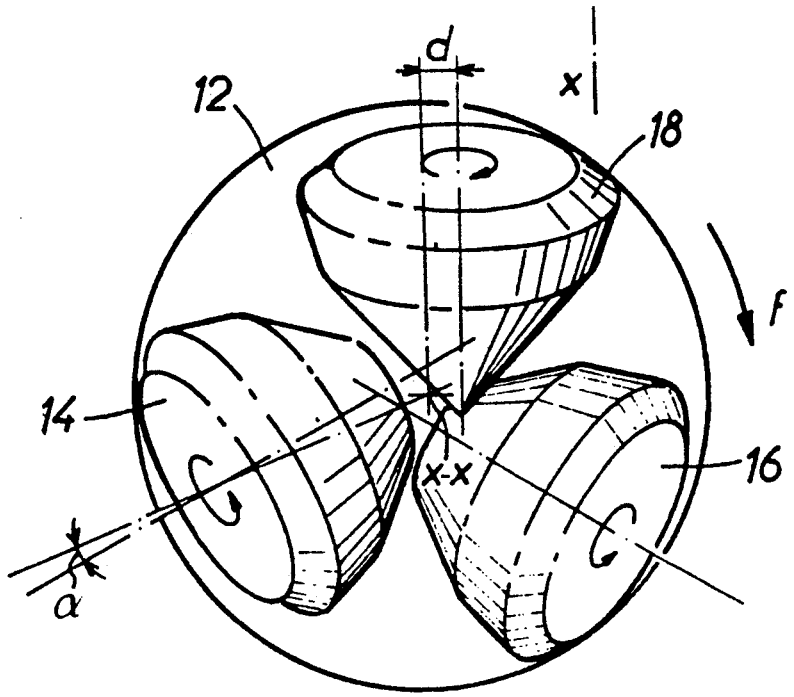
FIG. 2 is a view of the tricone from the lower end, the teeth or cutting points having been omitted for simplicity.
Figure 3:
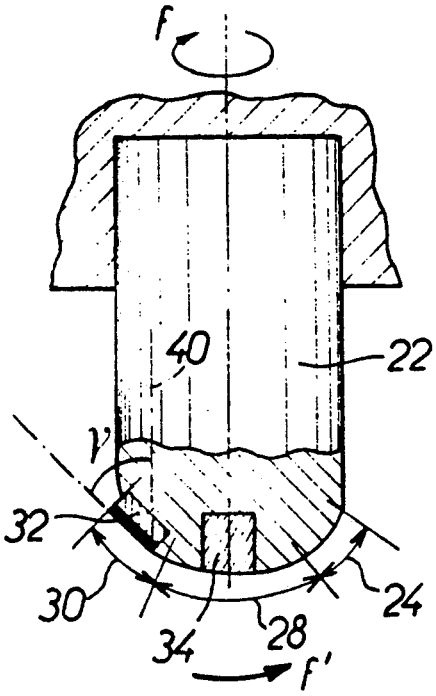
FIG. 3 is a side view, in partial cross-section, of a cutting point fitted with a diamond-charged element at its forward zone and at its central zone in accordance with the invention.
Figure 4:
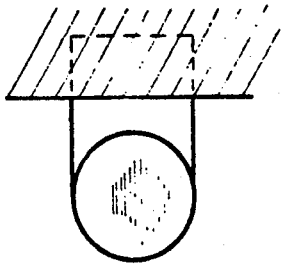
FIGS. 4 to 7 are side views of various types of cutting point configurations, seen from the left in FIG. 3, FIGS. 8 to 11 show four successive stages of the action of the cutting point in FIG. 3, on a rock, FIGS. 12 and 13 respectively show a plan view from the top and a profile view of a cutting point that has a slanting angle towards the inside of the tool.
Figure 5:
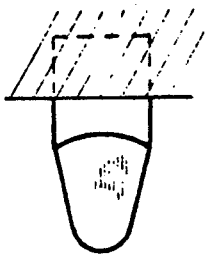
Figure 6:
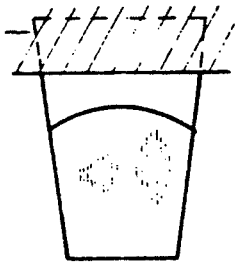
Figure 7:
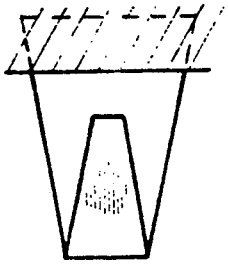

Referring to the drawings, the tooth or cutting point 22 in FIG. 3 is generally cylindrical, and one of its ends is set into a roller 14 of a tool, not shown, which is driven in rotation around a vertical axis, in the direction of arrow f of FIG. 3. The roller itself rolls on the rock 26 in the rotation direction f'.

In relation to the rotation direction f of the tool, the end of each cutting point 22 has a rear or impact zone 24 by which the cutting point comes into initial contact with the rock 26, a central or sliding zone 28 with a round shape in the lengthwise or planar direction, and a forward or shearing zone 30 which is the last to come into contact with the rock, prior to the roller tilting on the following cutting point.

In the forward zone 30 a diamond-charged element 32 is set or implanted, for instance a naturally-occurring diamond, an industrial diamond, or a diamond-charged concretion such as a plate of polycrystalline diamond or PDC, designed to ensure greater efficiency of the cutting point during shearing, abrading or puncturing. FIGS. 4 to 7 depict examples of the shape or configuration of the diamond-charged element.

The attack angle $\gamma$ lies in the forwardly directed plane of the tooth, between a perpendicular 40 to the rock and the face of the element 32. In the embodiment of FIG. 3, the diamond-charged element 32 is characterized as "aggressive" because it has a significant positive attack angle (between 10° and 40°) with the rock. Here, the diamond-charged element is used to shear the rock. Its behavior approximates that of a tool blade bit, the main difference being that the attack angle evolves (changes) during the rotation of the roller cone, as shown in FIGS. 8 to 11.

The attack angle can also be negative, in which case the face of the element 32 is to the rear in relation to the norm 40 to the rocky formation.

Figure 11:
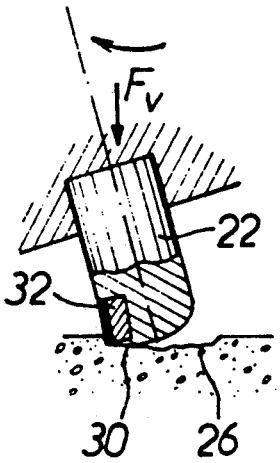
Figure 10:
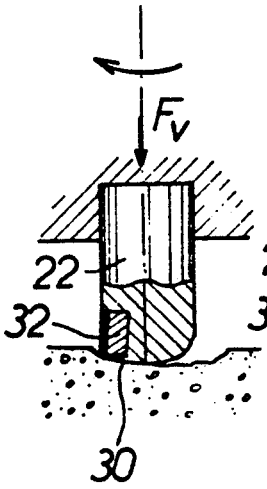
Figure 9:
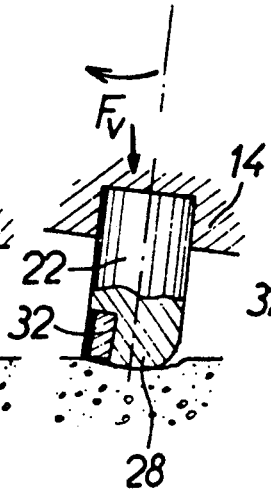
Figure 8:
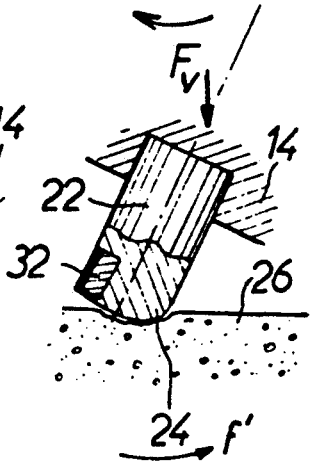

With tools that have a significant angular shift, during drilling the four following stages of destruction occur, respectively illustrated by FIGS. 8 to 11, according to the zone of the tooth which is in contact with the rock:

a) When the tooth 22 comes into contact with the rock 26 (FIG. 8), there basically is destruction through impact and puncturing, triggered by the rear zone 24 of the tooth. This zone must have qualities of resistance to shock and hardness. Tungsten carbide remains a material that is highly suited for this function.

b) After impact, the tooth 22 slides on the rock. The weight is distributed along the central zone 28 of the cutting point (FIG. 9). This zone must be hard and resistant to abrading. In this stage, the destruction of the rock occurs through scraping-abrading and puncturing.

c) The forward section 30 of the cutting point destroys the rock through shearing (FIG. 10). The attack angle is evolutionary and the action time is very short.

d) The cutting point 22 continues to turn, and its rear edge shears the rock (FIG. 11).

Figure 12:
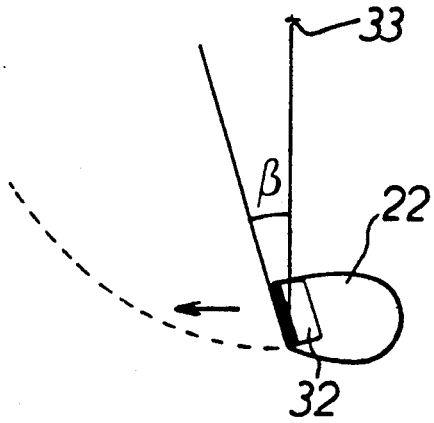
Figure 13:
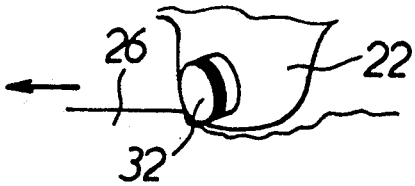
Figure 14:
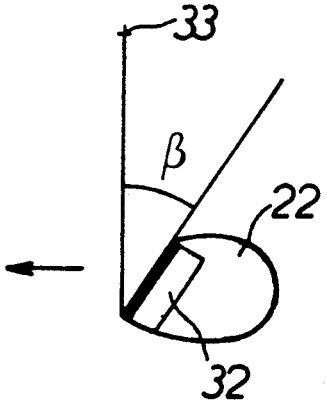
FIG. 14 shows a cutting point which forms an angle slanting towards the outside of the tool.

The diamond-charged element can also produce a slant angle $\beta$ ranging from 0° to 45° with the rock. In the embodiment of FIGS. 12 and 13, the slant angle is directed towards the inside of the tool. The point 33 depicts the rotation axis of the roller cone. In the embodiment of FIG. 14, the slant angle is directed towards the outside of the tool.

The teeth can also be fitted, along the central zone 28, with an additional diamond-charged element 34 or several linear rows of diamond-charged elements. The diamond-charged element 34 is placed immediately after the impact zone 24.

Figure 15:
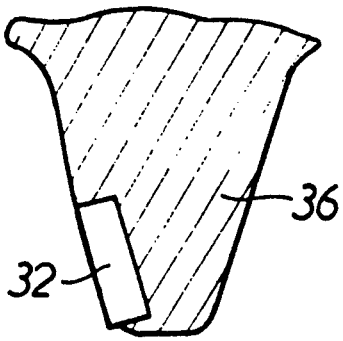
FIG. 15 shows a tooled tooth fitted with a diamond-charged element.

Instead of separately inserted teeth, the cones can include teeth 36 that are formed directly in the roller body, as shown in FIG. 15. It also goes without saying that diamond-charged elements can be set onto the teeth or cutting points even in the event of an angular shift equal to zero.

Thus, the invention has made it possible to improve resistance to wear and tear of the teeth or the cutting points of the rollers. It enables shearing work on a more intensive and efficient scale, work with a higher angular shift, without having to increase the level of wear and tear, as well as more pronounced destruction through shearing. It also applies to rollers with a high angular shift as well as to those with a weak or nil angular shift, by the fact that diamond-charged elements can be placed in the sections of the teeth or cutting points, other than those on which an initial impact or a strike occurs on the rock.

We claim:

1. A drilling tool (10), comprising: a rotatably driven body member (12), and a plurality o conical rollers (14, 16, 18) rotatably mounted to the body member, each roller having a plurality of circular rows of outstanding teeth (22) each made of tungsten carbide or the like, and an outer end of each tooth defining, successively in a direction of roll on a rock formation (26), a rear impact zone (24) by which the tooth initially contacts the rock formation and which functions by impact and puncturing, a central zone (28) with a rounded shape in a lengthwise direction which slides on the rock formation and which functions by scraping and abrading, and a forward zone (30) which is the last to come into contact with the rock formation, prior to the roller tilting on a following tooth, and which functions by shearing, wherein the teeth are individually fitted with diamond-charged elements (32) on at least said forward zone, but not on said rear impact zone.

2. A drilling tool according to claim 1, wherein said diamond-charged elements comprise one of naturally-occurring diamonds, industrial diamonds, and diamond-charged concretions, such as plates of crystalline polydiamonds, set on the respective teeth.

3. A drilling tool according to claim 1, wherein the central zone of each tooth is fitted with a diamond-charged element (34).

4. A drilling tool according to claim 1, wherein the central zone of each tooth is fitted with several linear rows of diamond-charged elements.

5. A drilling tool according to claim 1, wherein axes of the rollers define an angular shift angle ($\alpha$) with a radial plane crossing an axis (x—x) of the tool and a center of the base of the roller.

6. A drilling tool according to claim 5, wherein axes of the rollers have an angular shift angle of substantially zero.

7. A drilling tool according to claim 1, wherein each tooth is made of a single, unitary grade of tungsten carbide.

* * * * *